United States Patent [19]

Pellerin et al.

[11] Patent Number: 4,485,509

[45] Date of Patent: Dec. 4, 1984

[54] CONTINUOUS BATCH TYPE WASHING MACHINE AND METHOD FOR OPERATING SAME

[75] Inventors: Norvin L. Pellerin, New Orleans; James M. Katzfey, Kenner; Daniel P. Garcia, Jefferson, all of La.

[73] Assignee: Pellerin Milnor Corporation, Kenner, La.

[21] Appl. No.: 521,882

[22] Filed: Aug. 10, 1983

Related U.S. Application Data

[63] Continuation of Ser. No. 441,298, Nov. 12, 1982, abandoned, which is a continuation of Ser. No. 251,041, Apr. 17, 1981, abandoned.

[51] Int. Cl.[3] ..... D06F 31/00

[52] U.S. Cl. ..... 8/158; 68/27

[58] Field of Search ..... 8/158, 159; 68/9, 27, 68/58

[56] References Cited

U.S. PATENT DOCUMENTS

| | | | |
|---|---|---|---|
| 2,700,287 | 1/1955 | Sulzmann | 68/27 |
| 2,756,581 | 7/1956 | Von Boehmer et al. | 68/27 |
| 3,918,112 | 11/1975 | Seibt | 68/27 X |
| 4,210,004 | 7/1981 | Stoll et al. | 68/27 |
| 4,236,393 | 12/1980 | Katzfey | 68/27 |

FOREIGN PATENT DOCUMENTS

| | | | |
|---|---|---|---|
| 2900467 | 7/1980 | Fed. Rep. of Germany . | |
| 820385 | 9/1959 | United Kingdom | 68/27 |

OTHER PUBLICATIONS

Dreher-Contrain, Gluckstadter Reinigungswerk, Heidorn, Jan. 1979.

*Primary Examiner*—Philip R. Coe

*Attorney, Agent, or Firm*—Vaden, Eickenroht, Thompson, Bednar & Jamison

[57] ABSTRACT

There is disclosed a continuous batch type washing machine wherein means are provided for exchanging liquor in one or more of the successive compartments in which individual drums are rotatable in order to avoid injury to the goods due to incompatibilities between the goods and the liquor which would result from transfer of the goods into a compartment containing the liquor and/or circulation of the liquor into a compartment for a drum containing the goods.

24 Claims, 10 Drawing Figures

CONTINUOUS BATCH TYPE WASHING MACHINE AND METHOD FOR OPERATING SAME

Figure 1:
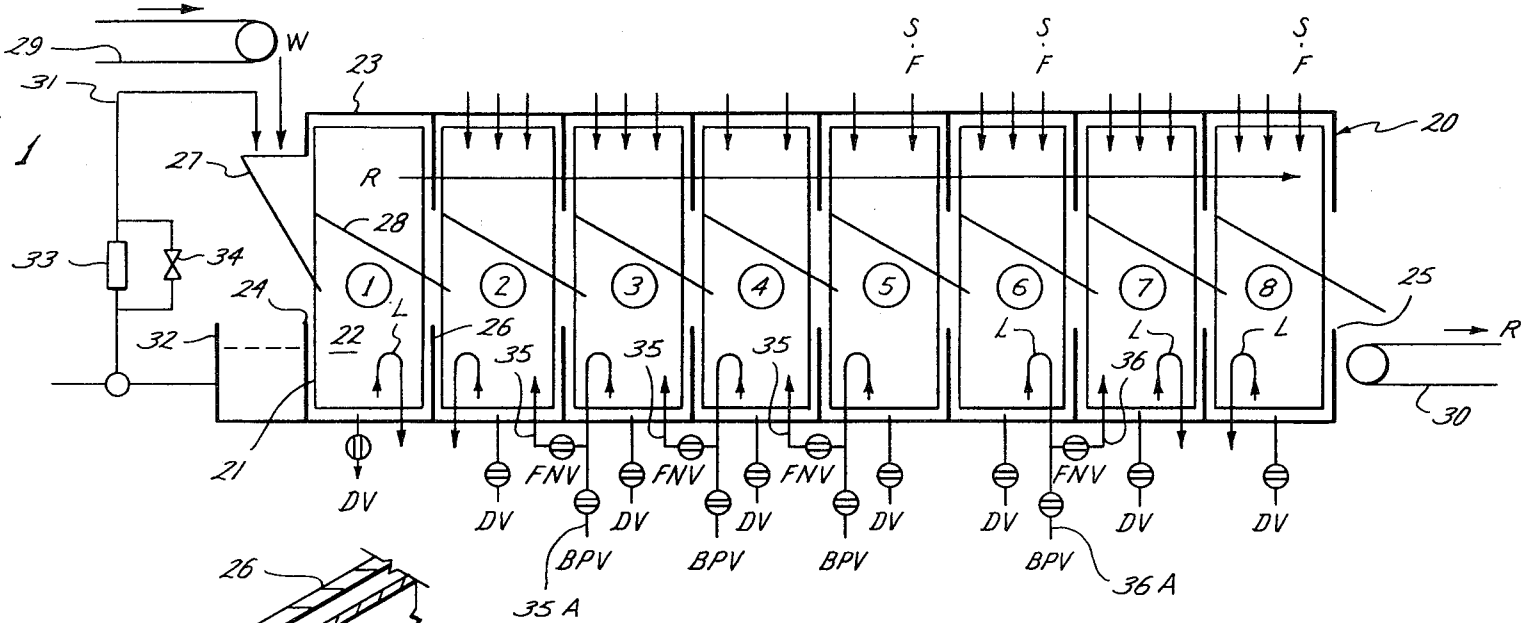

This is a continuation of application Ser. No. 441,298, filed Nov. 12, 1982, of Norvin L. Pellerin, James M. Katzfey and Daniel P. Garcia, entitled "Continuous Batch Type Washing Machine and Method for Operating Same", which is a continuation of Ser. No. 251,041, filed Apr. 17, 1981, entitled "Continuous Batch Type Washing Machine and Method for Operating Same", both now abandoned.

This invention relates in general to the washing of cloth goods, and, more particularly, to improvements in continuous batch type washing machines and methods for operating same.

In machines of this general type, which are also often known as "tunnel" washers, each of a succession of drums or baskets is mounted for rotation within a bath of liquor during each washing cycle, each bath being contained with an individual compartment of a succession of compartments forming the tunnel. Means are provided for transferring cloth goods from each drum into the next successive drum, intermediate washing cycles, and for causing liquor to circulate through each drum compartment and maintaining a desired level thereof making up the bath during each washing cycle. Thus, successive batches of cloth goods may be fed into the leading drum at front end and removed from the trailing at the rear end following passage through the intermediate drums.

Depending on the design and arrangement of the individual machine, water may be circulated through one or more drum compartments at the front portion of the machine for pre-wash purposes and soap may be added to the water circulated through several of the following drum compartments in the main wash stage of the machine. The goods may then be rinsed with water circulated through one or more succeeding drum compartments, and then bleached, starched or otherwise treated with chemicals added to the water circulated through the final drum compartments. In some cases, liquor may not pass entirely through the machine from one end to the other—e.g., certain of the different types of liquor may be prevented from commingling.

Since the goods are transferred from one drum to the next successive drum at the same time—i.e., during transfer cycles intermediate wash cycles—each batch is treated in each drum for the same length of time, whether that treatment be pre-wash, main wash, rinse or chemical. Consequently, and by way of example, the goods may have to pass through only a single drum during pre-wash, but several drums in order to be thoroughly washed and/or thoroughly rinsed. Thus, although, as previously mentioned, certain types of liquor may not be permitted to commingle with one another, liquor of a particular type may nevertheless be caused to circulate from one drum compartment into an adjacent drum compartment, and possibly from that drum compartment into one or more additional adjacent drum compartments. Furthermore, this circulation of liquor may be co-current with or contra to the direction in which the goods are transferred from one drum to the next successive drum of the machine.

Preferably, each drum has coaxial inlets and outlets in its opposite sides, and the goods are transferred through the outlet in one drum into the inlet in the next drum by means of a scoop-like member mounted within each drum and extending through openings in intermediate walls of the tunnel which divide it into compartments. Thus, as shown and described for example in U.S. Pat. No. 4,236,393, the scoops are of such construction that, when the drums are oscillated within limits, the goods therein are not transferred, but instead tumbled so as to promote thorough washing of the clothes. However, when the drums are rotated a predetermined extent in one direction, an inclined wall of the scoops assumes a position in which the goods are caused to slide downwardly thereover into the next drum. After a relatively short interval, during which the goods are transferred, the drum resumes its oscillatatory motion during a subsequent wash cycle. As known in the art, in other machines of this type, the cloth goods may be tumbled and washed during repeated full circle rotations of the drum in the opposite direction.

It is often necessary, or at least desirable, to pass through the machine a formula comprising successive batches of cloth goods which are incompatible in the sense that the liquor in which one batch is treated in a given compartment would be injurious to the goods in the adjacent drum compartment into which such liquor is next to flow. For example, if liquor in which goods dyed with fast colors had been washed was circulated into the drum compartment in which white goods were to be washed, it would of course add undesired color to the white goods. An incompatibility might also arise by virtue of the fact that the liquor in a given drum compartment would be injurious to the goods which are to be transferred from the next preceding drum compartment into that drum compartment. Thus, for example, in the example noted above, wherein dyed goods are followed by white goods, the liquor in the compartment into which such white goods are to be transferred would again add undesired color to them.

On the other hand, although successive batches of different goods may create an incompatibility when fed through the machine in one sequence, and thus in accordance with one formula, they may not when fed therethrough in the opposite order, and thus in accordance with another formula. For example, while dyed goods and white goods may create an incompatibility if the white goods follow the dyed goods, as above described, they may not if the order is reversed.

The reasons for incompatibility may be other than or in addition to color, as in the abovedescribed formula of white goods which follow goods containing dyestuff which is not colorfast. For example, temperature may be a factor in determining the incompatibilities of a given formula in that the liquor in one drum compartment may be too hot for the goods which are to enter it next, or for the goods in a drum compartment into which such liquor is to flow next. Chemicals may also be a factor in that the liquor in a given drum compartment may contain bleach which is incompatible with colored goods which are to enter it next. Or, liquor in a given drum compartment may be very dirty, due to soil from the goods washed in that compartment, and thus incompatible with clean goods which are next to enter it. It is thus in these senses, and other senses which will be apparent to those skilled in the art, that the term "incompatibility" is used throughout this application.

In the operation of prior machines of this type, it has been the practice to avoid, or at least mitigate, such incompatibilities by leaving certain of the drum compartments empty. However, this in effect negates the "continuous" aspect of the machine and thus cuts down on its capacity for any given period of time, and it is therefore the primary object of this invention to provide a machine of this general type which is of such construction and which may be so operated that batches may be passed continuously therethrough despite such incompatibilities. A more particular object is to provide such a machine, and method for operating it, which does not require extensive changes in and/or additions to existing machines of this type.

These and other objects are accomplished, in accordance with the illustrated embodiment of the present invention, by a machine which comprises, as in prior machines of the general type described, a means for transferring cloth goods from each drum into the next successive drum intermediate washing cycles, and for causing liquor to circulate through each drum compartment and from at least one compartment into an adjacent compartment of a pair of successive drum compartments, while being maintained at a desired level therein during a wash cycle. In addition, however, such machine comprises a means which is operable, at the beginning of each wash cycle, and in response to the incompatibility of the liquor in the one drum compartment with the goods in the adjacent drum compartment, for interrupting the circulation of liquor from said one into said adjacent drum compartment and diverting it elsewhere, and for replacing the liquor which the adjacent drum compartment was to receive from said one drum compartment with liquor compatible with the goods in the adjacent drum compartment, together with a means which is operable, at the end of each wash cycle, and in response to the incompatibility of liquor within the next successive drum compartment of said pair of compartments into which the goods are to be transferred upon completion of the wash cycle, for draining the liquor therefrom, and at the beginning of the next wash cycle, adding liquor to the next successive drum compartment into which such goods have been transferred which is compatible therewith in order to replace the liquor which was drained therefrom.

More particularly, the liquor may be caused to circulate from at least one drum compartment to the next successive drum compartment of a pair of adjacent drums. The liquor may also be caused to circulate from at least one drum compartment to the next preceding drum compartment of a pair of adjacent drum compartments. Furthermore, as in the illustrated embodiment of the present invention, in one stage of the machine, liquor may be caused to flow into the preceding drum compartment, and thus in counterflow relation with respect to movement of the goods, through the machine, and, in another stage, liquor may be caused to flow into the next successive drum compartment, and thus in a co-current relation with respect to the direction of movement of the goods through the machine.

More particularly, the preferred and illustrated embodiment of the machine includes means for draining liquor from each drum compartment and filling each drum compartment with liquor at a relatively fast rate, so that, in the event of an incompatibility between the liquor in a given drum compartment and the goods in the next preceding drum compartment, as above described, the liquor in the given drum compartment may be drained therefrom, just prior to transfer of the goods thereto, and replaced with liquor compatible with the goods following such transfer and at the start of the next wash cycle. Also, after the circulation of liquor from the one drum compartment into the other drum compartment has been interrupted and diverted elsewhere, at the beginning of a wash cycle, it may be reestablished at the start of the next wash cycle when the liquor in such one drum compartment is compatible with the goods in the other drum compartment. In any event, during operation of the machine, the means for so draining and filling, as well as the means for interrupting circulation and divertint it elsewhere, may be operated in response to observations of the incompatibilities of the particular formula of goods being moved through the machine.

As will be appreciated, particularly in the light of the description to follow, a machine of this general type may be so modified as to permit its operation in accordance with the present invention with relatively little additional cost. Furthermore, the existing parts and their functions may be retained without interfering with the operation of the present invention. Still, further, these additional parts may be programmed for operation automatically in response to the incompatibilities of the formulas, and thus with a minimum of personal attention on the part of the operator of the machine.

Figure 10:
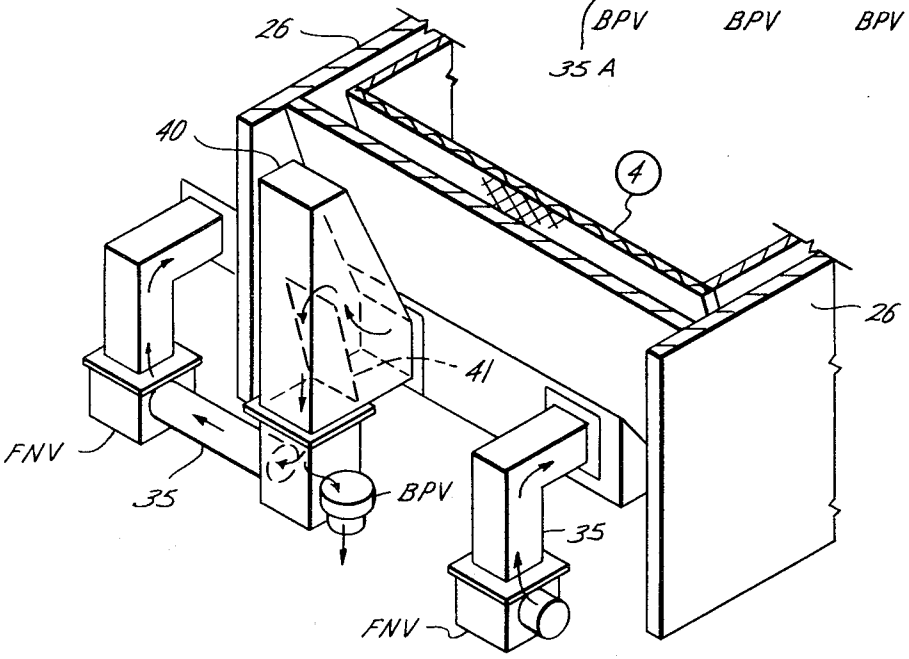

In the drawings, wherein like reference characters are used throughout to designate like parts:

FIGS. 1 to 9 are diagrammatic, longitudinal sectional views of a machine constructed in accordance with the present invention, and illustrating the manner in which such machine is operated during each successive washing cycle as batches of goods are caused to move continuously therethrough from one drum to another; and FIG. 10 is an enlarged, detailed perspective view of the means by which liquor in one drum compartment may be selectively circulated into the next preceding drum compartment or diverted elsewhere.

With reference now specifically to the abovedescribed drawings, the overall machine, which is indicated in its entirety by reference character 20, includes a succession of drums 21 each of which is rotatable during each washing cycle within a bath of liquor contained within individual compartments 22 of an elongate tunnel 23 intermediate dividing walls 26. The front (leftmost) compartment of the tunnel has a central inlet opening 24, the rear (rightmost) compartment of the tunnel has a central outlet opening 25, and coaxial openings are formed in the dividing walls between adjacent compartments.

In the illustrated machine, there are eight successive drums as indicated by the numerals assigned to them, each rotatable within an individual compartment to enable certain assigned functions to be performed therein during each wash cycle, as will be described, although this number and arrangement of the successive drums and compartments is merely typical. The drums are mounted in any suitable manner within the tunnel for coaxial rotation in opposite directions within each compartment, as shown, for example, in the aforementioned prior U.S. Pat. No. 4,236,393.

Inlet and outlet openings are provided in opposite sides of each drum, with the inlet of drum 1 opening to a chute at the inlet opening to the leading compartment, and the outlet of drum 8 opening to the outlet opening in the trailing drum. The inlets and outlets of adjacent drums are connected so that, during a transfer cycle intermediate wash cycles, goods may be moved through the outlet of one drum into the inlet of the adjacent drum. Thus, each drum has a scoop 28 which is of such construction that, upon rotation of the drum in one direction in a predetermined rotational position, as indicated diagrammatically in FIGS. 2 to 9, it transfers goods from that drum into the next succeeding drum by sliding downwardly over an inclined wall thereof. As previously described, the scoop or transfer means is also of such construction that, when oscillated within limits, or when rotated continuously in the direction opposite to that in which transfer takes place, the clothes will be caused to tumble within the drum in order to promote treatment of the cloth goods.

In the sense that the terms are used herein, transfer cycle means that interim the operation of the machine that the scoop or other transfer means occupies that position in which the goods are actually moved from one drum to the other, and wash cycle means those other interims prior to and following each transfer cycle—i.e., prior to or following movement of the scoop into or out of its transfer position.

Machine 20 is preferably of modular construction wherein each compartment and the drum rotatable therein provides an individual module adapted to be assembled with other modules into a tunnel of desired construction. In the illustrated machine, drum 1 is devoted to a pre-wash, while drums 2 and 3 are devoted to a main wash. The cloth goods are adapted to be rinsed in the drums 4 and 5, and to be chemically treated in the drums 6, 7 and 8. This chemical treatment may include a bleaching operation in the drums 6 and 7, and a starching operation in the drum 8. In the continuous operation contemplated by the present invention, dirty goods are introduced into the inlet chute 27 by means of a conveyor 29, and clean goods are received by a conveyor 30, from drum 8 for transport to an extractor of some type.

In the illustrated machine, liquor in the form of water is circulated into the compartment for pre-wash drum 1 by means of a conduit 31 leading from a container 32 for the water. The bath is maintained at a desired level in drum 1 by means of a weir indicated diagrammatically by loop L, which, as will be described in connection with FIG. 10, is preferably mounted on the outside of the tunnel. Water passing over the weir is drained to a sewer or other suitable place for disposal, as indicated by the downwardly pointed, long leg of the loop. Conduit 31 includes a parallel circuit having both a line 33 for fast-filling the compartment for drum 1 and a line 34 for filling it at a slow rate. Ordinarily, and in the absence of an incompatibility between the liquor in drum 1 and the goods next to be received therein from the chute 27, such as will be described to follow, water will be supplied to the container drum 1 by means of the slow-fill valve 34. However, the fast-fill line may also be used to flush cloth goods from the chute into the container for drum 1.

Liquor in the form of water is also added to the compartment for drum 5 at a relatively slow rate, as indicated by letters "S-F" above the arrow leading downwardly into the compartment, and is caused to circulate from the compartment for drum 5 into the compartment for drum 4, from the compartment for drum 4 into the compartment for drum 3, and from the compartment for drum 3 into the compartment for drum 2, by means of conduits 35 connecting adjacent compartments with one another. A similar loop having a weir at the upstream end of each such conduit maintains a desired level of liquor in the compartment to which it is connected. As shown, loop L leading from the compartment for drum 2 has a drain leg, as in the case of the loop leading from the compartment for drum 1. In the absence of incompatibilities to be described hereinafter liquor added to the compartment for drum 5 will be circulated through that compartment as well as compartments for drums 4, 3 and 2 in counterflow relation with respect to the direction of movement of the goods through the machine.

As will also be described to follow, chemical in the form of soap may be added to the liquor in the compartments for drums 2 and 3, as it is circulated therethrough from the compartments for drums 4 and 5. Also, additional chemical may be added to the liquor in each of compartments for drums 2 and 3 in order to augment chemical drained therefrom with liquor in the compartment, as will also be described.

In a similar manner, and in the absence of incompatibilities, liquor in the form of water which may contain bleach is circulated through and maintained at a desired level within the compartments for each of the drums 6 and 7. Thus, as indicated in FIG. 1, water is supplied to the compartment for drum 6 through a slow-fill line indicated by the letters "S-F" above the arrow in FIG. 1, and bleach is added to the water through a separate connection (not shown) to form the liquor which is circulated from this compartment into the compartment for drum 7 through a connecting conduit 36. The bath is maintained at a desired liquid level within the compartment for drum 6 by means of a loop L having a weir at the inlet end of connecting conduit 36, similarly to conduit 35, and by means of a loop L in the compartment for drum 7 having a drain leg therefrom similar to those above described. Thus, in the bleaching stage of the washing operation, the liquor flows in a co-current relation with respect to the movement of the goods through the machine.

The compartment for drum 8 is similar to the compartment for drum 1 in that, in the absence of an incompatibility, as will be described to follow, liquor is circulated through it independently of circulation from or into adjacent compartments. Thus, as shown in FIG. 1, water is supplied to the compartment for drum 8 through a slow-fill line indicated by the letters "S-F" above the arrow leading downwardly into the compartment, and starch is added to the water to form liquor which is maintained at a desired level in the compartment by means of a loop L having a drain leg leading to a suitable place of disposal outside of the compartment. As previously described, goods which are transferred out of the drum 8 slide downwardly over the scoop 28 onto a conveyor 30 for transport to an extractor.

For reasons which will be more fully understood from the description to follow, the compartments for drums 2 to 4 and 7, as well as those for the drums 5, 6 and 8, are provided with means for adding liquor therethrough at a slow rate, as indicated by the letters "S-F" above arrows leading thereto, and each of drums 2 through 8 are also provided with means for adding liquor thereto at a fast rate, as indicated by the letters "F-F" above an arrow leading downwardly into the upper end of the particular compartment. In addition, the letters "C-A" above an arrow extending downwardly into the compartments for drums 2, 3, 6, 7 and 8 indicate lines through which a chemical augmentation may be added thereto. These chemical augmentations may comprise, in a typical machine such as that illustrated, and in addition to soap in the case of the compartments for the main wash drums 2 and 3, as previously described, bleach in the case of the compartments for the drums 6 and 7, and starch in the case of the compartment for the drum 8.

In order to facilitate a description of the operation and function of the slow-fill, fast-fill lines and the chemical augmentation lines, the letters used to designate each appear only on those Figures in which such parts are in use during the wash cycle illustrated in that Figure. Thus, in the case of the initial wash cycle shown in FIG. 1, for example, the letters "S-F" appear only in connection with the lines for slow-filling the compartments for the drums 5, 6 and 8, the compartment for drum 1 of course being slow-filled with water from container 32 while the fast-fill line 33 in the conduit 31 is closed.

For purposes which will be more fully understood from the description to follow, each compartment is also provided with a means for draining the liquor therefrom at a rate substantially faster than it may drain from the loop L. For this purpose, each of FIGS. 1 to 9 shows a drain valve "DV" disposed within a drain leg leading downwardly from the lower end of each such compartment. During circulation of liquor through the compartment during a wash cycle, or when the compartment is being filled through fast-fill line "F-F", the drain valve "DV" therefrom will ordinarily be closed.

As previously described, a means is provided for selectively interrupting the circulation of liquor through conduits 35 and 36 from the compartment for one drum into the compartment of another drum, and diverting such liquor elsewhere, such as to a sewer or other suitable place of disposal as in the case of the drain legs of loops L. For this purpose, each of the conduits 35 connecting the compartments for drums 4 and 5, the compartments for drums 4 and 3, and the compartments for drums 3 and 2, has a valve "FNV" (flow-not valve) disposed therein, and another valve "BPV" (bypass valve) is disposed within a drain leg 35A extending downwardly from the conduit. Similarly, conduit 36 which connects the compartments for drums 6 and 7 has a flow-not valve "FNV" disposed therein, and a bypass valve "BPV" is disposed within the drain leg 36A therefrom.

In the absence of incompatibilities, and thus when it is desired to circulate liquor between adjacent compartments connected by these conduits, the flow-not valve "FNV" will be open and the bypass valve "BPV" will be closed. However, in the event of an incompatibility which dictates the interruption of such circulation, and the drainage of the liquor instead, as will also be described to follow, the flow-not valve is closed and the bypass valve opened. Thus, in the case of the wash cycle illustrated in FIG. 1, where there are no incompatibilities insofar as the compartments for the drums 2 through 8 are concerned, each flow-not valve is shown in open position and each bypass valve is shown in closed position.

The details of the conduits for circulating liquor from one compartment into an adjacent compartment are shown in FIG. 10 in connection with the compartment for the drum 4. Thus, the loop L is contained within a box 40 connecting with an outlet in the side of the compartment with the conduit 35, and a weir plate 41 is disposed within the box to control the level of liquid within the compartment as liquor circulates through the box and into the conduit 35, as indicated by the arrows of FIG. 10. The opposite end of the conduit 35 is connected with an inlet to the adjacent compartment for the drum 3 (not shown), and the downstream end of the conduit 35 for circulating liquor from the compartment for drum 5 into the compartment for drum 4 is also shown as connecting with an inlet to the compartment for drum 4.

Figure 7:
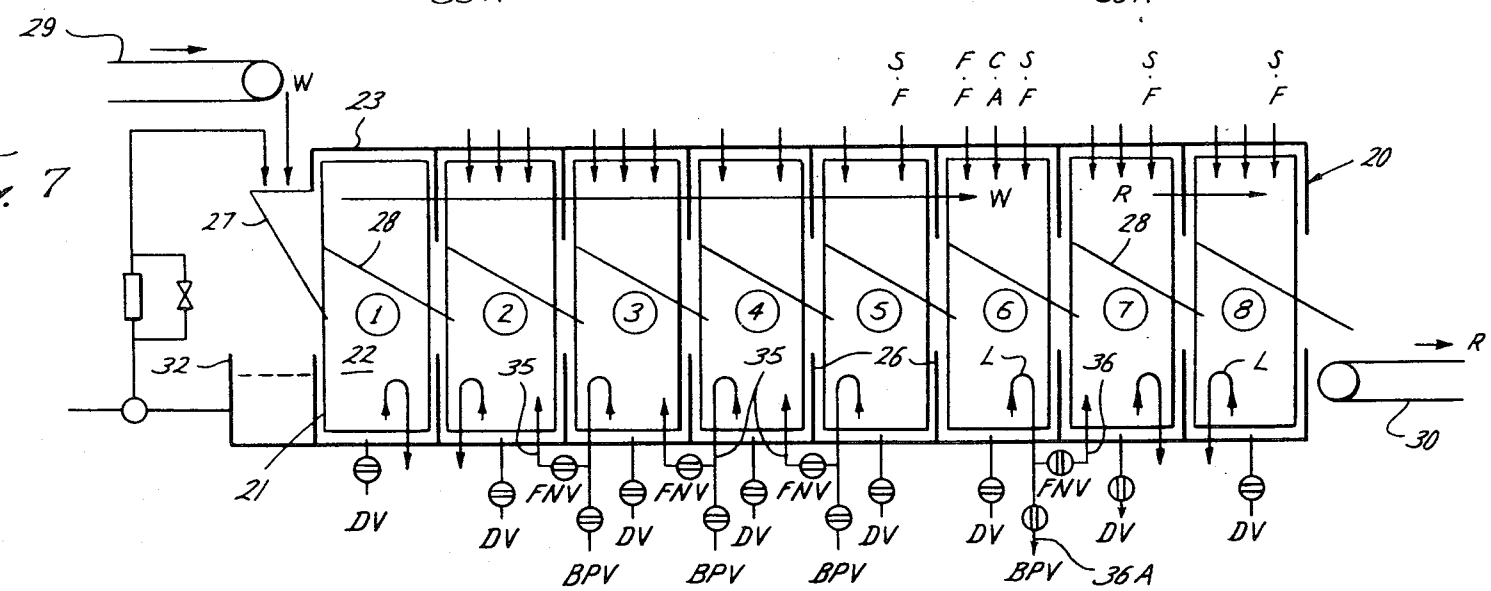
Figure 8:
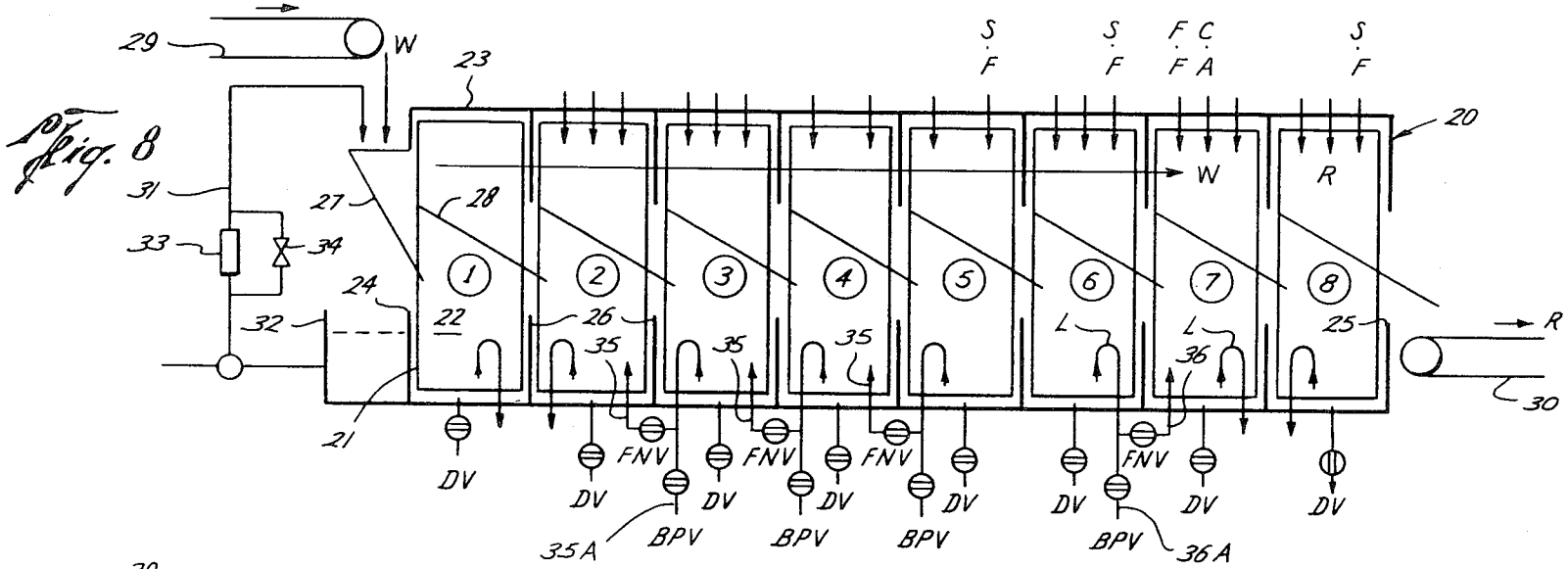
Figure 9:
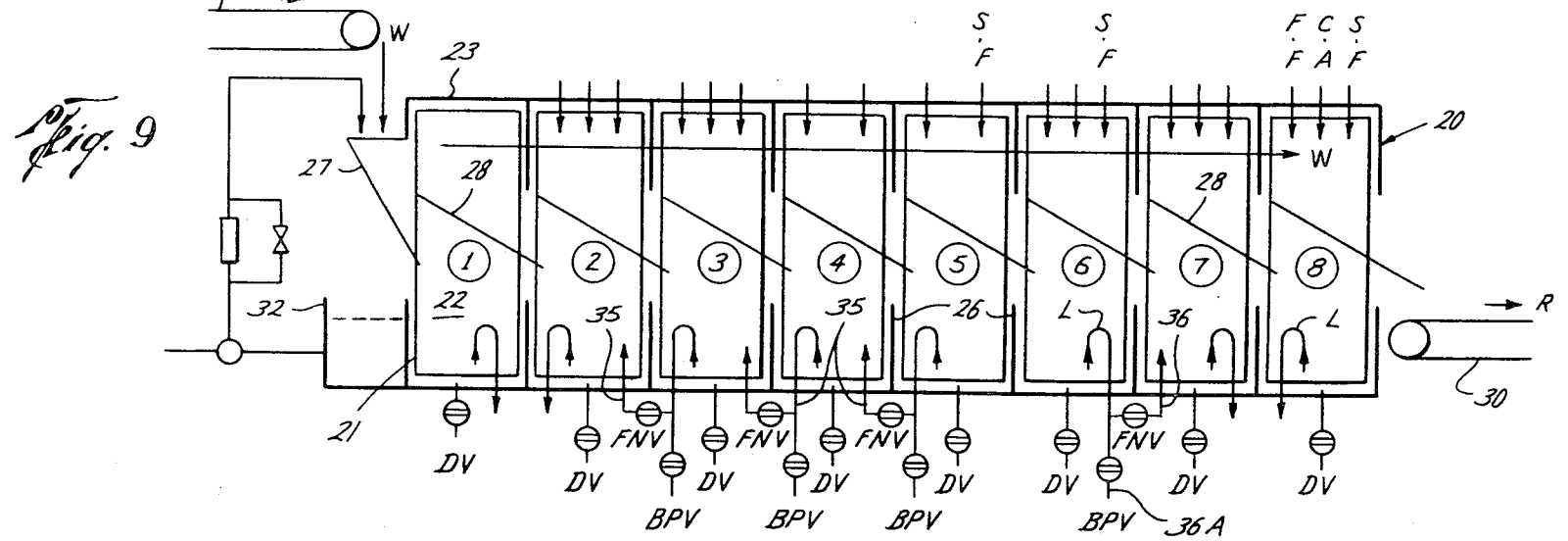

As illustrated in FIGS. 1 to 9 by the letters "R" and "W" within the drums, goods containing a red dye ("R") are caused to move from drum 1 through drum 8 and onto the conveyor 30, followed by white goods ("W") which are caused to move from the conveyor 29 and through each of the drums 1 to 7 into the drum 8, as shown in FIG. 9. As previously described, during any wash cycle, the liquor in a compartment in which the dyed goods are treated is incompatible with the white goods, in the sense that introduction of that liquor into the compartment containing the white goods, or introduction of the white goods into the compartment containing that liquor, would be injurious to the white goods. In most cases, the liquor in which the white goods are treated is compatible with the dyed goods, and thus the dyed goods may be transferred from one compartment into another compartment in which that liquor is contained, or the liquor may be circulated into a compartment in which the dyed goods are contained, without injury to the dyed goods. As will be explained to follow, however, there are instances in which the liquor for treating the white goods may be incompatible with the dyed goods, such as, for example, when that liquor contains bleach which would be injurious to the dyed goods.

It will be understood that this particular formula of goods to be moved through the machine, and thus the operation of the machine in connection with the successive wash cycles to be described in connection with FIGS. 1 to 9, is merely typical and for the purposes of illustrating the present invention. It is believed, however, that in the light of this description, those skilled in the art will be able to operate the machine in a manner to accommodate other formulas of goods to be moved therethrough, and which, as in the case of the above-described program, create certain incompatibilities.

Figure 2:
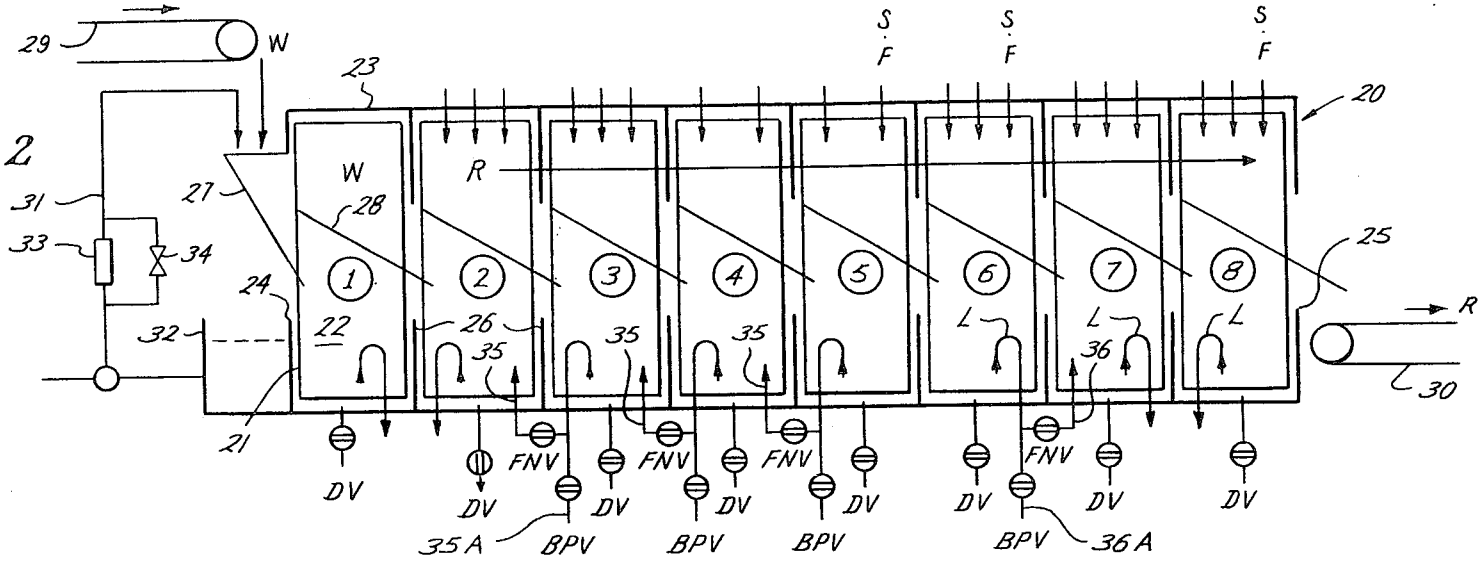

With reference now to the wash cycle illustrated in FIG. 1, wherein the dyed goods R are in the drum 1 and white goods W are on the conveyor 29 prior to being emptied into chute 27, there is an incompatibility between the liquor in the compartment for drum 1 and the white goods on the conveyor in the sense that the liquor in the bath in which the dyed goods have been pre-washed would be injurious to the white goods. Consequently, just prior to transfer of the white goods into drum 1, drain valve "DV" from the compartment for drum 1 is opened, as shown in FIG. 1, so as to rapidly drain the liquor therefrom. The conveyor then causes the white goods to be dumped into the chute 27, and thus to be transferred into the drum 1, and the drums 1 through 8 move through the transfer cycle to transfer goods therein into the next succeeding drum. Upon completion of the transfer cycle, and at the start of the next wash cycle, the drain valve is closed, as shown in FIG. 2, and valve 33 in conduit 31 is opened to quickly fill the compartment for drum 1 with liquor in the form of water. When water has filled the compartment to the desired level, as determined by a suitable level control switch (not shown), the fastfill valve 33 is automatically closed and the slow-fill valve 34 opened so as to add water to the compartment for the pre-wash drum 1 at a relatively slow rate, the desired level of the liquor being maintained by the weir of the loop L for the compartment, and the water flowing over the weir into the drain leg of the loop.

When the dyed goods R have been transferred into the compartment for drum 2, as shown in FIG. 2, there is an incompatibility between the liquor in the bath for the drum 2 and the white goods W in the drum 1. Thus, as the transfer scoop for drum 2 moves into a position to transfer goods from drum 2 into drum 3, drain valve "DV" from the compartment for drum 2 is opened to quickly drain the liquor therefrom, as shown in FIG. 2. As the drum continues to rotate into the transfer mode, the dyed goods in drum 2 are transferred into drum 3, and the white goods in drum 1 are transferred into drum 2.

Figure 3:
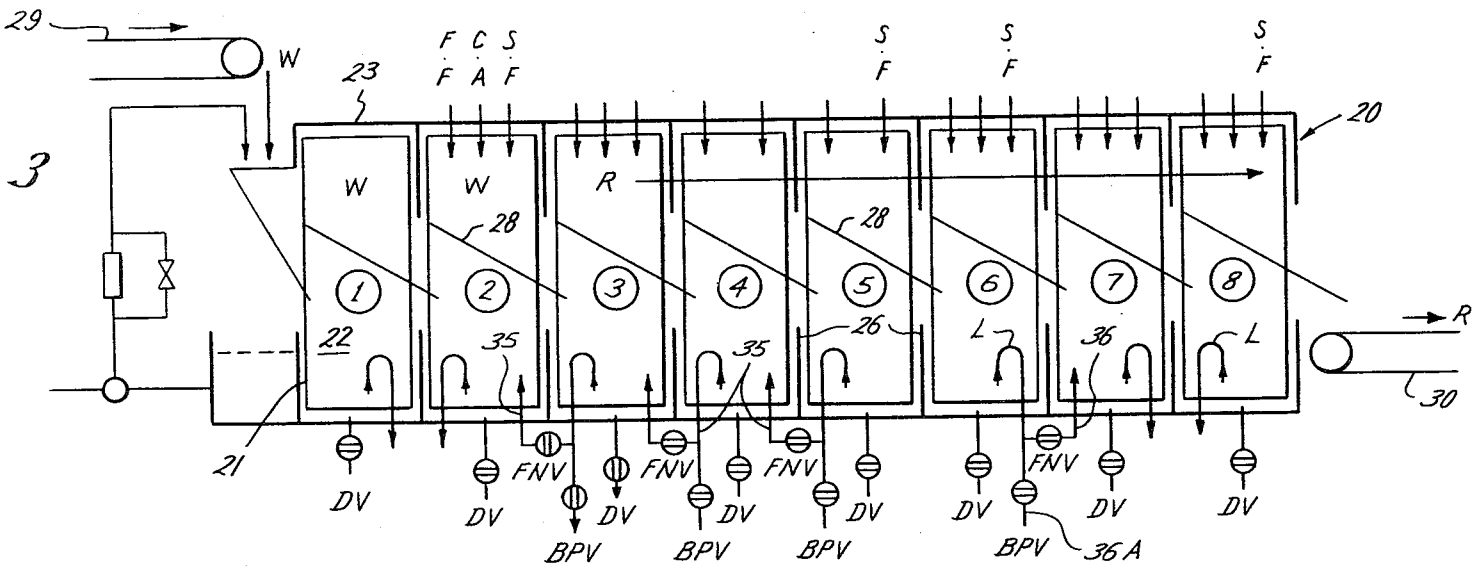

At the beginning of the third wash cycle illustrated in FIG. 3, an incompatibility exists between the liquor in the compartment for drum 3 and the white goods in drum 2 in that the introduction of that liquor through the conduit 35 into the compartment for drum 2 would be injurious to the white goods. Thus, the flownot valve FNV in the conduit is closed and the bypass valve BPV in the drain leg therefrom is opened, as shown in FIG. 3, whereby the circulation of liquor entering the compartment of drum 5 through the slowfill line "S-F" and into the compartment for drum 2 is interrupted and diverted elsewhere through the drain leg.

Just before the wash cycle begins, the drain valve "DV" from the compartment for drum 2 is closed, and the fast-fill line "F-F" therefor is then opened in order to quickly replace water which had been drained from the compartment upon opening of the drain valve. When the water has reached the proper level, the fast-fill line is closed and the slow-fill line leading to the compartment for drum 2 is opened to cause the water to circulate into and through the compartment, its level being maintained by means of the loop L from which it is drained. At the beginning of this wash cycle, the soap which was added to the compartment by suitable means (not shown) is augmented by soap added thereto through the chemical augmentation line C-A to this compartment, as indicated in FIG. 3, so as to replace soap which was lost while draining the compartment for drum 2.

At the end of this wash cycle, the drain valve for the compartment of drum 3 is opened, as shown in FIG. 3, so as to drain liquor therefrom which is incompatible with the white goods which are to be transferred into the drum 3 from the drum 2. As the scoop 28 in the drum 3 moves into its full transfer position, the dyed goods R therein are of course transferred from the drum 3 into the drum 4, as indicated in FIG. 4.

Figure 4:
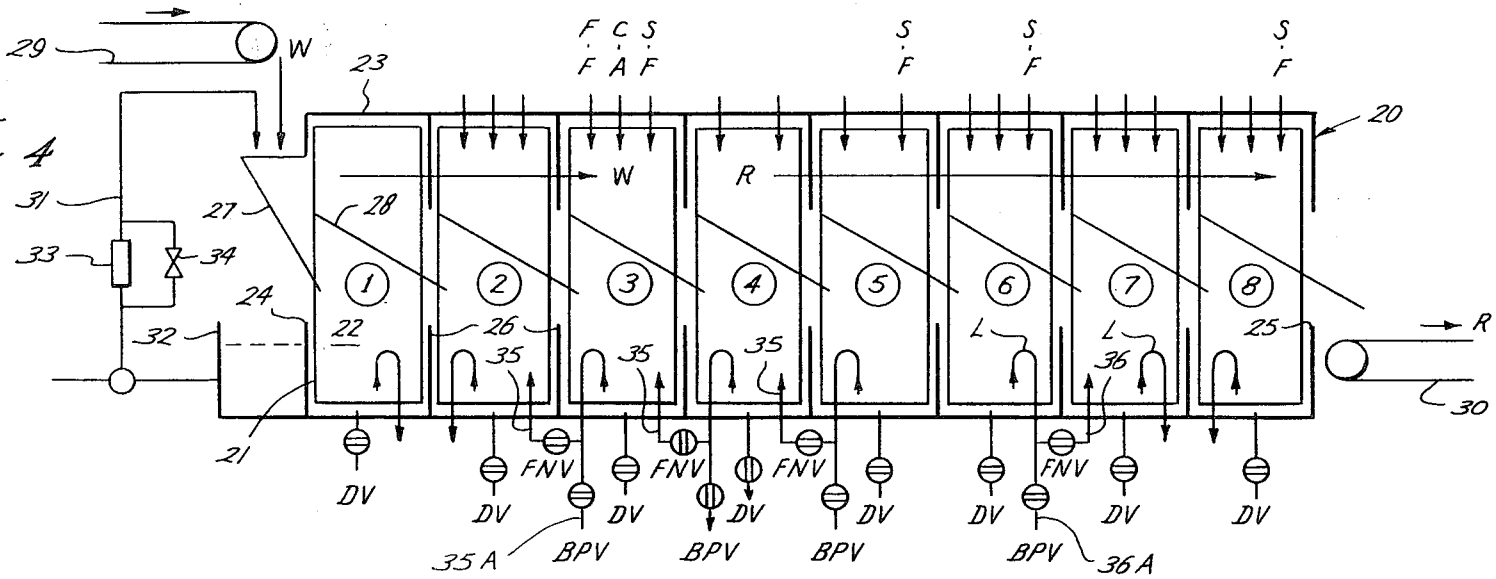

Just before the fourth wash cycle illustrated in FIG. 4, the drain valve from the compartment for drum 3 is closed and the fast-fill line "F-F" leading thereto is opened to quickly fill that compartment with water to the desired level, following which it is closed and the slow-fill line "S-F" leading to the same compartment opened. The supply of soap to this compartment is augmented through line C-A leading thereto, as described in connection with the compartment for drum 2. Also, the flow-not valve FNV in the conduit 35 connecting the compartment for drum 4 with the compartment for drum 3 is closed, and the bypass valve BPV in the drain therefrom opened, as shown in FIG. 4, so as to interrupt circulation of liquor therebetween and divert it elsewhere through the drain leg in which valve BPV is disposed.

In addition, flow-not valve in the conduit 35 connecting compartments for drums 3 and 2 is opened, and the bypass valve BPV in the drain leg therefrom closed, as also shown in FIG. 4, so that water entering the compartment for the drum 3 through the slow-fill line "S-F" therefor will be circulated through conduit 35 into the compartment for drum 2 and then through the loop L into the drain from the compartment for drum 2, the loop on the upstream end of conduit 35 maintaining the desired level of liquor in the compartment for drum 3. Due to the fact that compartment for drum 2 now receives water from the compartment for drum 3, the slow-fill line thereto which was open during wash cycle 3, as shown in FIG. 3, may be closed.

Figure 5:
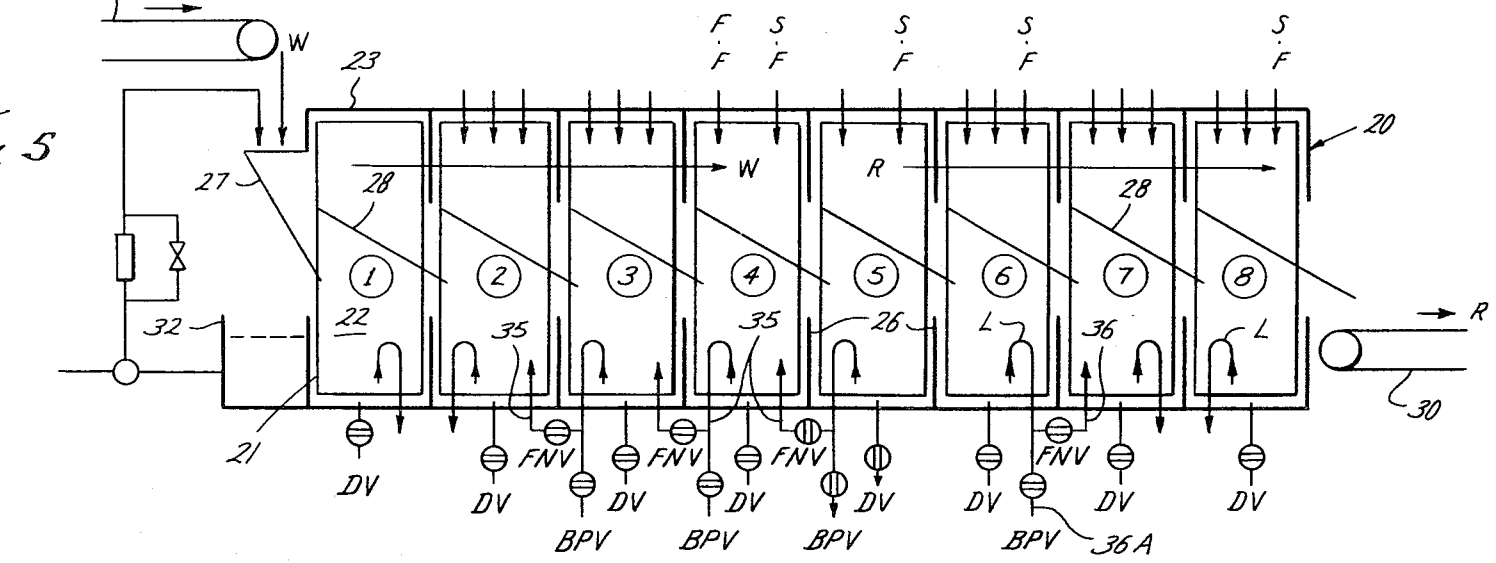

At the end of the fourth wash cycle, the drain valve from the compartment for drum 4 is opened to quickly drain liquor therefrom, as shown in FIG. 4, following which goods from the compartment for drum 3 are transferred into drum 4, and the dyed goods in compartment 4 are transferred into compartment 5, as shown in FIG. 5. At this time, drain valve DV from the compartment for drum 4 is closed, and fastfill line leading into the compartment is opened, as shown in FIG. 5, to quickly fill the compartment with water to the desired level. When this level is reached, the fast-fill line is closed and the slowfill line also shown in FIG. 5 is opened to continue to supply water to the compartment for the drum 4, which is maintained at such level by the loop in the inlet end of the conduit 35 connecting the compartments for drums 3 and 4.

The flow-not valve in this conduit 35 is moved from the closed position of FIG. 4 to the open position of FIG. 5, the bypass valve BPV in the drain leg of such conduit is closed, and the slow fill line leading into the compartment for the drum 3 is closed. Thus, the slow supply of water into the compartment for drum 4 will be circulated from that compartment into the compartment for drum 3 and then into the compartment for drum 2, the level in each of the compartments for drums 3 and 4 being maintained by means of the loop L at the inlet ends of the conduits. The loop for the compartment for drum 2 will continue to drain liquor therefrom while maintaining a desired level thereof.

Due to the incompatibility between the liquor in the compartment for drum 5 and the white goods in the compartment for drum 4, the flow-not valve FNV in the conduit 35 connecting the compartment for drum 5 with the compartment for drum 4 is closed, and the bypass valve BPV in the drain leg from such conduit is opened. As a result, water circulating through the compartment for drum 5 will be drained therefrom without circulating into and through the compartments for drums 4, 3 and 2. Since the goods are merely rinsed in drums 4 and 5, there is no need for chemical augmentation lines as in the case of the compartments for drums 2 and 3. At the end of this cycle, and just before the transfer scoop of drum 4 reaches its transfer position, the drain valve DV of the compartment for drum 5 is opened, as shown in FIG. 5, to rapidly drain liquor therefrom just prior to the transfer of the white goods from drum 4 into drum 5, and the dyed goods from the compartment for drum 5 into the compartment for drum 6, as shown in FIG. 6.

Figure 6:
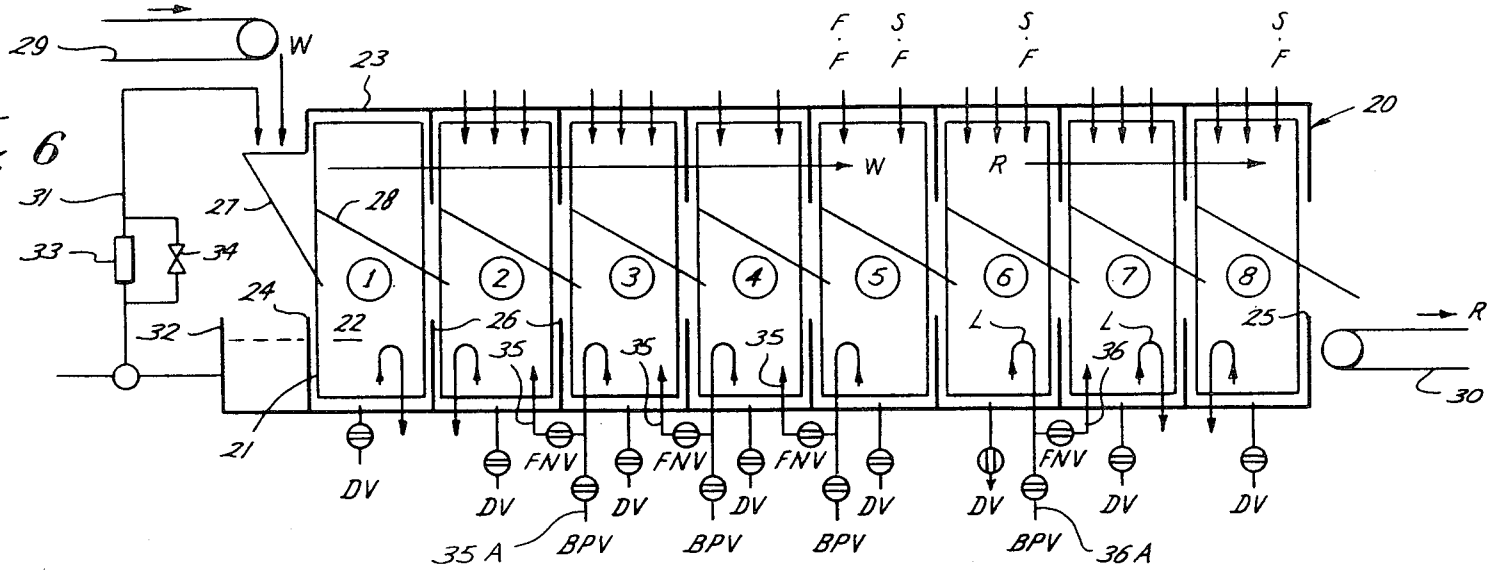

As shown in FIG. 6, the drain valve from the compartment for drum 5 is closed, and the fast-fill line "F-F" leading thereto is opened to rapidly fill the compartment with main wash liquor. When this liquor reaches a desired level, the fast-fill line is closed, and the slow-fill line leading to the same compartment is opened. The flow-not valve FNV in the conduit 35 connecting the compartment for drum 5 with the compartment for drum 4 is moved from the closed position of FIG. 5 to the open position of FIG. 6, and the bypass valve BPV in the drain leg therefrom is closed, as also shown in FIG. 6. Consequently, fresh liquor supplied to the compartment for the drum 5 circulates into and through the compartment for drum 4, and from the compartment from drum 4 into the compartment for drum 3, etc., whereby the slow-fill line leading to the compartment for drum 4 may be closed.

It will be noted that, at this stage, the incompatibility between the liquor in the compartment for the drum 6 and the white goods in drum 5 results not from the circulation of such liquor into the compartment for drum 5, as was previously described in connection with other adjacent compartments, but rather because of the introduction, at the end of the sixth washing cycle, of the white goods into the compartment for the drum 6. Consequently, just before the scoop in the drum 5 reaches its transfer position, the drain valve from the compartment for drum 6 is opened, as shown in FIG. 6, to quickly drain liquor therefrom prior to the transfer of white goods from drum 5 into drum 6. As the drums move into the transfer cycle, the dyed goods in drum 6 are of course also transferred into the drum 7, as shown in FIG. 7.

At the beginning of the seventh wash cycle, there are incompatibilities in two senses. First, the liquor in the compartment for drum 7 is incompatible with the white goods in drum 6 which are to be transferred into the drum 7 following the sixth wash cycle. Thus, in keeping with the continuous operation of the overall machine, it is necessary to quickly fill the compartment for the drum 6 with liquor for the seventh wash cycle. However, there is another incompatibility in the sense that the white goods are to receive chemical in the form of a bleach added to the compartment for drum 6. This chemical in the liquor of the compartment for drum 6 would be injurious to the dyed red goods in the drum 7. Consequently, since the compartments are connected by conduit 36, the flow-not valve in such conduit is closed and the bypass valve in the drain leg thereof opened, as shown in FIG. 7, to prevent the bleach from being circulated into the compartment for drum 7. Since the circulation of liquor from the compartment for drum 6 has been interrupted, the compartment for drum 7 must be supplied with liquor from another source, and hence the slow-fill line "S-F" leading to such compartment is opened, as shown in FIG. 7, in order to reestablish circulation therethrough, which is then maintained at a desired level by the loop for drum 7.

Just prior to the end of this seventh wash cycle, the drain valve from the compartment for drum 7 is opened, as shown in FIG. 7, to quickly drain liquor therefrom. As the scoop in drum 6 reaches its transfer position, the white goods in drum 6 are moved into drum 7, and the dyed goods from drum 7 are transferred into drum 8, as also shown in FIG. 8.

At the beginning of the eighth wash cycle, as shown in FIG. 8, the drain valve from the compartment for drum 7 is closed, and the fast-fill line leading thereto is opened to replace the liquor which has been drained therefrom, and the chemical augmentation line C-A is opened to replace the chemicals that have been lost in the liquor. Also, the flow-not valve FNV in the conduit 36 is opened and the bypass valve in the drain leg therefor closed, so that when the drained liquor has been replaced in the compartment 7, the fast-fill line may be closed and the level therein maintained as liquor supplied through the slow-fill line leading to the compartment for drum 6 is circulated through the conduit 36 into the compartment for drum 7, and then drained therefrom through the loop L in the compartment for drum 7.

Just prior to the end of the eighth wash cycle, the drain valve from the compartment for drum 8 is opened, as shown in FIG. 8, so as to drain liquor from the compartment, following which the white goods in the drum 7 are transferred into drum 8, the dyed goods from drum 8 are transferred into the conveyor 30.

Although, at the beginning of the ninth wash cycle, the last batch of dyed red goods R are out of the machine and moving on the conveyor 30 toward the extractor, it is nevertheless necessary to drain the liquor from the compartment for the drum 8 inasmuch as that liquor is incompatible with the white goods W which are transferred into the drum from the drum 7 at the end of the eighth wash cycle. Then, of course, it is necessary to rapidly fill the compartment for the drum 8 with liquor through the fast-fill line leading to that compartment, as shown in FIG. 9, the drain valve from that compartment having been closed. When this liquor reaches the desired level, fast-fill line is closed and the slow-fill line "S-F" is open, the loop L for such compartment maintaining the desired level of liquor therein as it is circulated therethrough. Chemical in the form of starch may be added to the new supply of liquor, and augmented through chemical augmentation line C-A, as also indicated in FIG. 9, to replace the starch lost upon drainage of the liquor from the compartment for drum 8.

The relatively uncomplicated functions to be performed in the operation of a conventional machine of this type wherein the goods moving through the machine are identical and/or there are otherwise no causes for incompatibility, are ordinarily programmed. Thus, the user of the machine need not constantly monitor these functions, which would include, in addition to starting and stopping of the wash cycles, other functions dependent on the formula of the goods moving through the machine, which may dictate temperature changes, addition of chemicals, etc.

A machine constructed in accordance with the present invention would also preferably be designed to operate automatically in response to incompatibilities created by the formulas, such as those previously mentioned. In the above-described operation, the formula is of course relatively uncomplicated—i.e., simply dyed goods followed by white goods—but is believed adequate to illustrate the basic concepts of the present invention.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. In a continuous batch type washing machine having a succession of drums each of which is rotatable within a bath of liquor contained within an individual compartment of a succession of compartments during each washing cycle, and wherein means are provided for transferring cloth goods from each drum into the next successive drum intermediate wash cycles, and liquor is caused to circulate through each drum compartment and from at least one drum compartment to an adjacent drum compartment of a pair of successive drum compartments, while being maintained at a desired level therein, during each washing cycle, the improvement comprising means operable at the beginning of each wash cycle, and in response to the incompatibility of the liquor in the one drum compartment with the goods in the adjacent drum compartment, for interrupting the circulation of liquor from said one into said adjacent drum compartment and diverting it elsewhere, and for replacing the liquor which said adjacent drum compartment was to receive from said one drum compartment with liquor compatible with the goods in said adjacent drum compartment, and means operable at the end of each wash cycle, and in response to the incompatibility of liquor within the drum compartment into which the cloth goods are to be transferred from the preceding drum compartment of said pair of compartments upon completion of said wash cycle, for draining said liquor therefrom, and at the beginning of the next wash cycle, adding liquor to the drum compartment into which said goods have been transferred which is compatible therewith in order to replace the liquor which was drained therefrom.

2. In a machine of the character defined in claim 1 wherein the liquor in the drum compartment into which the goods are to be transferred included a chemical which was added thereto, the further improvement comprising additional means operable at the beginning of said next wash cycle for augmenting the liquor added to said drum with chemical in order to replace that which was lost in draining.

3. In a continuous batch type washing machine having a succession of drums each of which is rotatable within a bath of liquor contained within an individual compartment of a succession of compartments during each washing cycle, and wherein means are provided for transferring cloth goods from each drum into the next successive drum intermediate wash cycles, and liquor is caused to circulate through each drum compartment and from at least one drum compartment to the next successive drum compartment of a pair of successive drum compartments, while being maintained at a desired level therein, during each washing cycle, the improvement comprising means operable at the beginning of each wash cycle, and in response to the incompatibility of the liquor in the one drum compartment with the goods in the next successive adjacent drum compartment, for interrupting the circulation of liquor from said one into the next successive adjacent drum compartment and diverting it elsewhere, and for replacing the liquor which said next successive adjacent drum compartment was to receive from said one drum compartment with liquor compatible with the goods in said next successive adjacent drum compartment, and means operable at the end of each wash cycle, and in response to the incompatibility of liquor within the drum compartment into which the cloth goods are to be transferred from the preceding drum compartment of said pair of compartments, upon completion of said wash cycle, for draining said liquor therefrom, and at the beginning of the next wash cycle, adding liquor to the said drum compartment into which said goods have been transferred which is compatible therewith in order to replace the liquor which was drained therefrom.

4. In a machine of the character defined in claim 3 wherein the liquor in the drum compartment into which the goods are to be transferred included a chemical which was added thereto, the further improvement comprising additional means operable at the beginning of said next wash cycle for augmenting the liquor added to said drum with chemical in order to replace that which was lost in draining.

5. In a continuous batch type washing machine having a succession of drums each of which is rotatable within a bath of liquor contained within an individual compartment of a succession of compartments during each washing cycle, and wherein means are provided for transferring cloth goods from each drum into the next successive drum intermediate wash cycles, and liquor is caused to circulate through each drum compartment and from at least one drum compartment to the next preceding drum compartment of a pair of succeeding drum compartments, while being maintained at a desired level therein, during each washing cycle, the improvement comprising means operable at the beginning of each wash cycle, and in response to the incompatibility of the liquor in the one drum compartment with the goods in the next preceding adjacent drum compartment, for interrupting the circulation of liquor from said one into the next preceding adjacent drum compartment and diverting it elsewhere, and for replacing the liquor which said next preceding adjacent drum compartment was to receive from said one drum compartment with liquor compatible with the goods in said next preceding adjacent drum compartment, and means operable at the end of each wash cycle, and in response to the incompatibility of liquor within the drum compartment into which the cloth goods are to be transferred from the preceding drum compartment of said pair of compartments, upon completion of said wash cycle, for draining said liquor therefrom, and at the beginning of the next wash cycle, adding liquor to the next preceding adjacent drum compartment into which said goods have been transferred which is compatible therewith in order to replace the liquor which was drained therefrom.

6. In a machine of the character defined in claim 5, wherein the liquor in the drum compartment into which the goods are to be transferred included a chemical which was added thereto, the further improvement comprising additional means operable at the beginning of said next wash cycle for augmenting the liquor added to said drum with chemical in order to replace that which was lost in draining.

7. In a method for operating a continuous batch type washing machine which has a succession of drums each of which is rotatable within a bath of liquor contained within an individual compartment of a succession of compartments during each wash cycle, and wherein means are provided for transferring cloth goods from each drum into the next successive drum intermediate wash cycles, and for causing liquor to circulate through each drum compartment and from one drum compartment to an adjacent drum compartment of a pair of successive drum compartments, while a desired level of liquor is maintained within each drum compartment, during each wash cycle, the improvement comprising the steps of observing when liquor in the one drum compartment is incompatible with the goods in the adjacent drum compartment, and, in response to the observed incompatibility and at the beginning of each wash cycle, causing the circulation of liquor from said one into said adjacent drum compartment to be interrupted and diverted elsewhere, and replacing the liquor which said adjacent drum compartment was to receive from said one drum compartment with liquor compatible with goods in said adjacent drum compartment, and observing when liquor within the drum compartment of said pair of drum compartments into which the cloth goods are to be transferred is incompatible with such goods, and, in response to such observed incompatibility, causing the liquor to be drained therefrom at the end of each wash cycle, and, at the beginning of the next wash cycle, adding liquor to the drum compartment into which said goods have been transferred which is compatible therewith in order to replace the liquor which has been drained therefrom.

8. In a method of the character defined in claim 7, wherein a chemical is added to the liquor in the drum compartment into which the goods are to be transferred, the further improvement comprising the additional step of augmenting the liquor added to the drum with chemical in order to replace that which is drained therefrom.

9. In a method for operating a continuous batch type washing machine which has a succession of drums each of which is rotatable within a bath of liquor contained within an individual compartment of a succession of compartments during each wash cycle, and wherein means are provided for transferring cloth goods from each drum into the next successive drum intermediate wash cycles, and for causing liquor to circulate through each drum compartment and from one drum compartment to the next successive drum compartment of a pair of adjacent drum compartments, while a desired level of liquor is maintained within each drum compartment, during each wash cycle, the improvement comprising the steps of observing when liquor in the one drum compartment is incompatible with the goods in the next successive adjacent drum compartment, and, in response to the observed incompatibility and at the beginning of each wash cycle, causing the circulation of liquor from said one into said next successive adjacent drum compartment to be interrupted and diverted elsewhere, and replacing the liquor which said next successive adjacent drum compartment was to receive from said one drum compartment with liquor compatible with goods in said successive adjacent drum compartment, and observing when liquor within the drum compartment into which the cloth goods are to be transferred is incompatible with such goods, and, in response to such observed incompatibility, and causing the liquor to be drained therefrom at the end of each wash cycle, and, at the beginning of the next wash cycle, adding liquor to the next adjacent successive drum compartment into which said goods have been transferred which is compatible therewith in order to replace the liquor which was drained therefrom.

10. In a method of the character defined in claim 9, wherein a chemical is added to the liquor in the drum compartment into which the goods are to be transferred, the further improvement comprising the additional step of augmenting the liquor added to the drum with chemical in order to replace that which is drained therefrom.

11. In a method for operating a continuous batch type washing machine which has a succession of drums each of which is rotatable within a bath of liquor contained within an individual compartment of a succession of compartments during each wash cycle, and wherein means are provided for transferring cloth goods from each drum into the next successive drum intermediate wash cycles, and for causing liquor to circulate through each drum compartment and from one drum compartment to the next preceding drum compartment of a pair of adjacent drum compartments, while a desired level of liquor is maintained within said drum compartment, during each wash cycle, the improvement comprising the steps of observing when liquor in the one drum compartment is incompatible with the goods in the next preceding adjacent drum compartment, and, in response to the observed incompatibility and at the beginning of each wash cycle, causing the circulation of liquor from said one into said next preceding adjacent drum compartment to be interrupted and diverted elsewhere, and replacing the liquor which said next preceding adjacent drum compartment was to receive from said one drum compartment with liquor compatible with goods within said preceding adjacent drum compartment, and observing when liquor within the drum compartment into which the cloth goods are to be transferred is incompatible with such goods, and, in response to such observed incompatibility, and causing the liquor to be drained therefrom at the end of each wash cycle, and, at the beginning of the next wash cycle, adding liquor to the next adjacent successive drum compartment into which said goods have been transferred which is compatible therewith in order to replace the liquor which was drained therefrom.

12. In a method of the character defined in claim 11, wherein a chemical is added to the liquor in the drum compartment into which the goods are to be transferred, the further improvement comprising the additional step of augmenting the liquor added to the drum with chemical in order to replace that which is drained therefrom.

13. A continuous batch type washing machine, comprising a succession of drums each of which is rotatable within a bath of liquor contained within an individual compartment of a succession of compartments during each washing cycle, means for transferring cloth goods from each drum into the next successive drum intermediate wash cycles, means for circulating liquor from one drum compartment into the next successive drum compartment of a pair of adjacent drum compartments, or for alternatively draining liquor from said one compartment elsewhere when said liquor exceeds a predetermined level within said one compartment, whereby in the event liquor in said one drum compartment is incompatible with the goods in said next successive drum compartment, its circulation may be interrupted and diverted elsewhere at the beginning of the wash cycle, and then reestablished at the start of the next wash cycle when the liquor in said one drum compartment is compatible with the goods in said next successive drum compartment, means for draining liquor from said next successive drum compartment when the liquor therein exceeds a predetermined level, means for adding liquor to said next successive compartment at a relatively slow rate in order to replace liquor which said next successive compartment does not receive upon the interruption of circulation therebetween, means for draining liquor from and adding liquor to the next successive drum compartment, which is to receive goods from said one drum compartment, at a relatively fast rate, so that in the event of an incompatibility between the liquor in the next successive drum compartment and the goods in the one drum compartment, the liquor in the next successive drum compartment may be quickly drained therefrom, just prior to transfer of said goods thereto, and quickly replaced with liquor compatible with said goods following such transfer and at the start of the next wash cycle, and means for stopping the addition of liquor to said successive compartment at a relatively fast rate, when the liquor therein reaches the predetermined level, and then continuing to add liquor thereto at a relatively slow rate in order to reestablish circulation therethrough.

14. A washing machine of the character defined in claim 13, including means for adding liquor to said one drum compartment at a relatively fast rate, so that liquor which may have been drained therefrom may be quickly replaced.

15. A washing machine of the character defined in claim 13, including means for adding chemical to the next successive drum compartment at the start of a wash cycle, and means for adding additional chemical to the next successive drum so as to augment the chemical already added thereto in order to replace that which is not received from the circulation of liquor from said one compartment.

16. A continuous batch type washing machine, comprising a succession of drums each of which is rotatable within a bath of liquor contained within an individual compartment of a succession of compartments during each washing cycle, means for transferring cloth goods from each drum into the next successive drum intermediate wash cycles, means for circulating liquor from one drum compartment into the next preceding drum compartment of a pair of adjacent drum compartments, or for alternatively draining liquor from said one compartment elsewhere when said liquor exceeds a predetermined level within said one compartment, whereby in the event liquor in said one drum compartment is incompatible with the goods in said next preceding drum compartment, its circulation may be interrupted and diverted elsewhere at the beginning of the wash cycle, and then reestablished at the start of the next wash cycle when the liquor in said one drum compartment is compatible with the goods in said next preceding drum compartment, means for draining liquor from said next preceding drum compartment when the liquor therein exceeds a predetermined level, means for adding liquor to said next preceding compartment at a relatively slow rate in order to replace liquor which said next preceding compartment does not receive upon the interruption of circulation therebetween, means for draining liquor from and adding liquor to the one drum compartment, which is to receive goods from said next preceding drum compartment, at a relatively fast rate, so that in the event of an incompatibility between the liquor in the one drum compartment and the goods in the next preceding drum compartment, the liquor in the one drum compartment may be quickly drained therefrom, just prior to transfer of said goods thereto, and quickly replaced with liquor compatible with said goods following such transfer and at the start of the next wash cycle, and means for stopping the addition of liquor to said one compartment at a relatively fast rate, when the liquor therein reaches the predetermined level, and then continuing to add liquor thereto at a relatively slow rate in order to reestablish circulation therethrough.

17. A washing machine of the character defined in claim 16, including means for adding liquor to said next preceding drum compartment at a relatively fast rate, so that liquor which may have been drained therefrom may be quickly replaced

18. A washing machine of the character defined in claim 16, including means for adding chemical to the one drum compartment at the start of a wash cycle, and means for adding additional chemical to the one drum so as to augment the chemical already added thereto in order to replace that which is not received from the circulation of liquor from said next preceding compartment.

19. In a method for operating a continuous batch type washing machine, which comprises a succession of drums each of which is rotatable within a bath of liquor contained within an individual compartment of a succession of compartments during each washing cycle, means for transferring cloth goods from each drum into the next successive drum intermediate wash cycles, means for circulating liquor from one drum compartment into the next successive drum compartment of a pair of adjacent drum compartments, and for alternatively draining liquor from said one compartment elsewhere, while maintaining said liquor a predetermined level therein, means for draining liquor from said next successive drum compartment when the liquor therein exceeds a predetermined level therein, means for adding liquor to said next successive compartment at a relatively slow rate, means for draining liquor from and adding liquor to the next successive drum compartment, which is to receive goods from said one drum compartment, at a relatively fast rate, means for stopping the addition of liquor to said successive compartment at a relatively fast rate, and then continuing to add liquor thereto at a relatively slow rate, the steps of observing when liquor in said one drum compartment is incompatible with the goods in said next successive drum compartment, and, in response to such observed incompatibility and at the beginning of the wash cycle, interrupting its circulation and diverting it elsewhere, and adding liquor to said next successive drum compartment at a relatively slow rate in order to replace liquor which said next successive compartment does not receive upon the interruption of circulation, observing when the liquor in the next successive drum compartment is incompatible with goods in the one drum compartment, and quickly draining the liquor from the next successive drum compartment, in response to the observed incompatibility and just prior to the transfer of goods thereto, and quickly replacing the drained liquor with liquor compatible with said goods following such transfer and at the start of the next wash cycle, and observing when the liquor in said one drum compartment is compatible with the goods in said next successive drum compartment, and in response to the observed compatibility and at the start of the next wash cycle, discontinuing the addition of liquor to said next successive drum compartment at a relatively slow rate, and reestablishing circulation of liquor thereto from said one drum compartment.

20. In a method of the character defined in claim 19, including the further step of adding liquor to said one drum compartment at a relatively fast rate, so that liquor which may have been drained therefrom may be quickly replaced.

21. In a method of the character defined in claim 19, including the further steps of adding chemical to the next successive drum compartment at the start of a wash cycle, and adding additional chemical to the next successive drum so as to augment the chemical already added thereto in order to replace that which is not received from the circulation of liquor from said one compartment.

22. In a method for operating a continuous batch type washing machine, which comprises a succession of drums each of which is rotatable within a bath of liquor contained within an individual compartment of a succession of compartments during each washing cycle, means for transferring cloth goods from each drum into the next successive drum intermediate wash cycles, means for circulating liquor from one drum compartment into the next preceding drum compartment of a pair of adjacent drum compartments, and for alternatively draining liquor from said one compartment elsewhere, while maintaining said liquor a predetermined level therein, means for draining liquor from said next preceding drum compartment when the liquor therein exceeds a predetermined level therein, means for adding liquor to said next preceding compartment at a relatively slow rate, means for draining liquor from and adding liquor to the next preceding drum compartment, which is to receive goods from said one drum compartment, at a relatively fast rate, means for stopping the addition of liquor to said preceding compartment at a relatively fast rate, and then continuing to add liquor thereto at a relatively slow rate, the steps of observing when liquor in said one drum compartment is incompatible with the goods in said next preceding drum compartment, and, in response to such observed incompatibility and at the beginning of the wash cycle, interrupting its circulation and diverting it elsewhere, and adding liquor to said next preceding drum compartment at a relatively slow rate in order to replace liquor which said next preceding compartment does not receive upon the interruption of circulation, observing when the liquor in the one drum compartment is incompatible with goods in the next preceding drum compartment, and quickly draining the liquor from the one drum compartment, in response to the observed incompatibility and just prior to the transfer of goods thereto, and quickly replacing the drained liquor with liquor compatible with said goods following such transfer and at the start of the next wash cycle, and observing when the liquor in said one drum compartment is compatible with the goods in said next preceding drum compartment, and in response to the observed compatibility and at the start of the next wash cycle, discontinuing the addition of liquor to said next preceding drum compartment at a relatively slow rate, and reestablishing circulation of liquor thereto from said one drum compartment.

23. In a method of the character defined in claim 22, including the further step of adding liquor to said next preceding drum compartment at a relatively fast rate, so that liquor which may have been drained therefrom may be quickly replaced.

24. In a method of the character defined in claim 22, including the further steps of adding chemical to the next preceding drum compartment at the start of a wash cycle, and adding additional chemical to the next preceding drum so as to augment the chemical already added thereto in order to replace that which is not received from the circulation of liquor from said one compartment.

* * * * *